US005544632A

United States Patent [19]

Choate

[11] Patent Number: 5,544,632

[45] Date of Patent: Aug. 13, 1996

[54] REMOVABLE ENGINE PLATE AND INSTALLATION METHOD THEREFOR

[76] Inventor: Randall W. Choate, 1916 Bonnie View Ct., Evansville, Ind. 47715

[21] Appl. No.: 422,216

[22] Filed: Apr. 14, 1995

[51] Int. Cl.[6] ..... F02F 7/00

[52] U.S. Cl. ..... 123/195 C; 184/106

[58] Field of Search ..... 123/195 C; 184/6.5, 184/106

[56] References Cited

U.S. PATENT DOCUMENTS

| | | | |
|---|---|---|---|
| 1,737,466 | 12/1927 | Lind | 123/195 C |
| 4,068,646 | 1/1978 | Hnojsky | 123/195 C |
| 4,457,274 | 7/1984 | Gottlob | 123/195 C |
| 4,770,276 | 9/1988 | Takubo | 123/195 C |
| 5,038,890 | 8/1991 | Tanaka et al. | 184/106 |
| 5,058,545 | 10/1991 | Hirai et al. | 123/195 C |
| 5,130,014 | 7/1992 | Volz | 184/106 |
| 5,161,642 | 11/1992 | Murakawa | 123/195 C |

FOREIGN PATENT DOCUMENTS 59-126052A 9/1982 Japan .

*Primary Examiner*—Noah P. Kamen
*Attorney, Agent, or Firm*—Richard C. Litman

[57] ABSTRACT

A conventional internal combustion engine oil pan having a throughbore which is sealingly covered by a gasket and plate mounted over the throughbore and fixed thereto with threaded fasteners. A method for installing the engine plate is also provided.

5 Claims, 1 Drawing Sheet

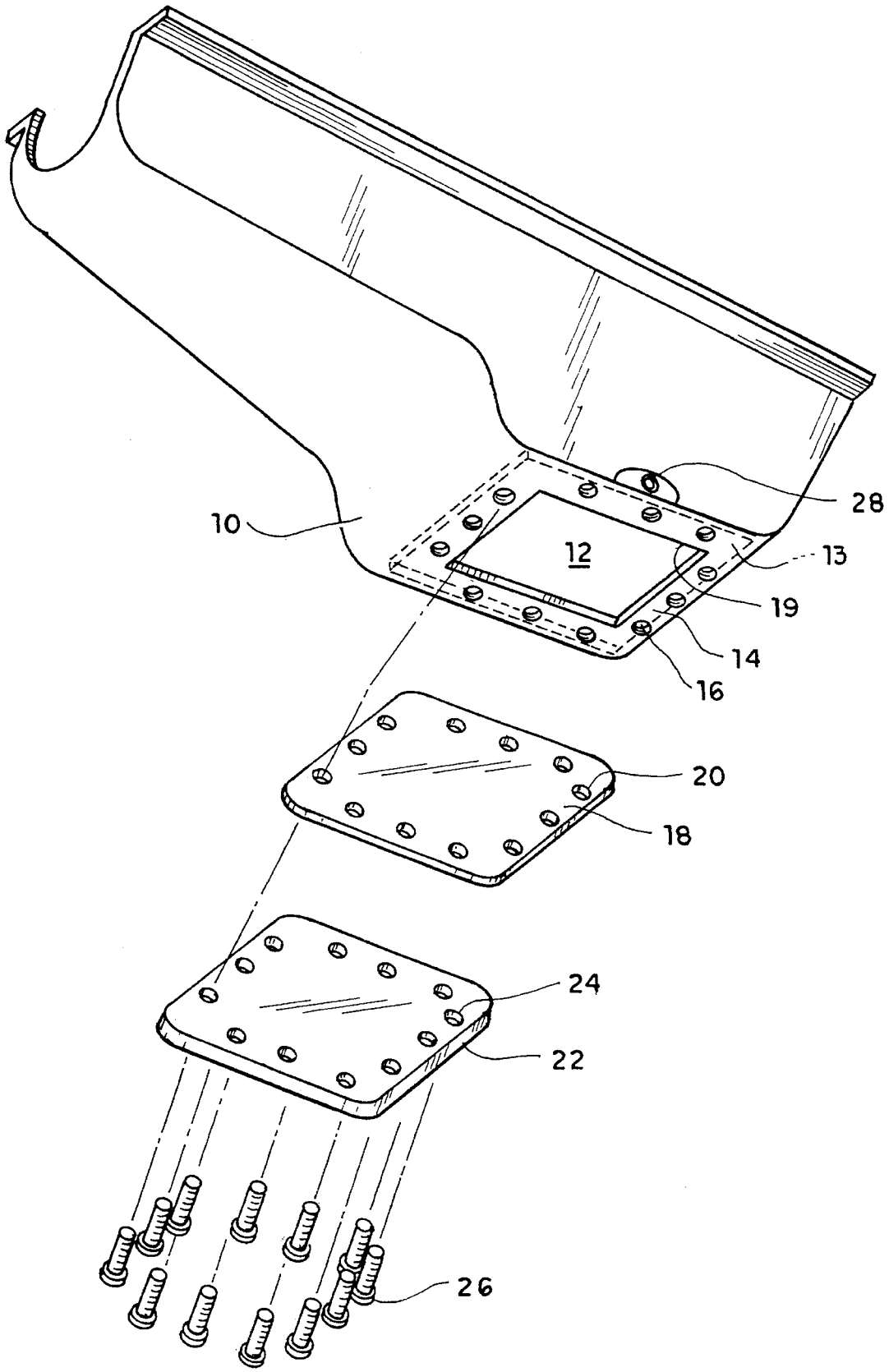
28
10
12
13
19
14
16
20
18
24
22
26

REMOVABLE ENGINE PLATE AND INSTALLATION METHOD THEREFOR

BACKGROUND OF THE INVENTION

1. Field of the Invention

This invention relates to internal combustion engine oil pans. More specifically, the present invention relates to a demountable, sealable plate for a throughbore in an internal combustion engine oil pan and a method for installing the engine plate.

2. Description of the Prior Art

An internal combustion engine oil pan is located beneath the engine. The oil pan collects the oil that is circulated through the engine. The engine's mechanical pump draws oil from the oil pan for continuous oil circulation in the engine.

Removing the oil pan provides access to the main bearings, crankshaft, throws, connecting rods and seals, and other mechanisms. These items occasionally require maintenance or repairs. Unfortunately, multiple design considerations drive the configuration of the oil pan and the environment in which it is assembled. Typically, the oil pan is trapped behind a web of cross members, steering members and shielding. Removal of the oil pan is typically a substantial undertaking. Maintenance to the vehicle requiring oil pan removal is usually quite costly.

Several types of removable engine plates are described in the literature. For example, U.S. Pat. No. 1,737,466, issued Dec. 12, 1927, to Harry J. Lind, describes a noise eliminator for internal combustion engines. The device includes a lower crank case cover extending the entire length of the crankcase cavity. The cover has a flange that mates with the cavity periphery. The cover has two gaskets disposed on the inner and outer surface of the flange. A protecting plate seats on the outside of the outer gasket. The cover, gaskets and plate are bolted to the oil pan with a plurality of bolts.

U.S. Pat. No. 4,068,646, issued Jan. 17, 1978, to Joseph F. Hnojsky, describes a crank case oil pan. The device includes a plurality of sections. When the sections are sealed and bolted together, they form an oil pan extending the entire length of the crank case cavity.

U.S. Pat. No. 4,457,274, issued Jul. 3, 1984, to Clifford E. Gottlob, describes an oil pan assembly. The device includes an auxiliary oil pan with a four-sided bottom and three walls extending generally perpendicularly from three of the sides, respectively. A throughbore is cut into the back, generally vertical panel of a vehicle's oil pan. Then the device is permanently welded onto the back end of the oil pan. The device increases the oil capacity of the oil pan.

U.S. Pat. No. 4,770,276, issued Sep. 13, 1988, to Hiroichi Takubo, describes an oil pan for automotive engine. The device includes an L-shaped cover plate demountably fixed with threaded fasteners to a clutch housing opening. No sealing means between the plate and housing is described. The opening provides access to a bolt for securing the clutch housing to the cylinder block.

U.S. Pat. No. 5,161,642, issued Nov. 10, 1992, to Tomohiro Murakawa, describes an oil pan construction. The invention includes a skirt surrounding the crank case cavity. A generally horizontal blanking plate mounts with threaded fasteners to the bottom of the skirt defining a crankcase volume. The blanking plate extends almost the entire length of the crank case cavity.

Japanese Patent 59-126052 (A), published Sep. 9, 1982, issued to Masahiro Noda, in the abstract describes an oil pan.

The device appears to include a four-sided bowl that is welded to the oil pan over a throughbore therein. The device is purposed at increasing structural rigidity of an extant oil pan.

None of the above references, taken alone or in combination, are seen as teaching or suggesting the presently claimed removable engine plate and installation method therefor.

SUMMARY OF THE INVENTION

The present invention relates to internal combustion engine oil pans. The present device is for an oil pan having a throughbore. The oil pan may also have secured to it a reinforcing member. The oil pan has a plurality of threaded bores peripherally disposed about the throughbore. In practice, the reinforcing member should be installed, if at all, prior to cutting the threaded bores in the oil pan to assure registration of the threaded bores in the oil pan and reinforcing member. A gasket and plate sealingly mount to the oil pan over the throughbore. The plate and gasket each have a plurality of throughbores peripherally disposed and in registration with threaded bores in the oil pan. Conventional bolts fix the plate and gasket to the oil pan.

The present method is for installing the removable engine plate. The method includes cutting a throughbore in the oil pan, cutting threaded bores about the peripheral edge of the throughbore, and mating a gasket and plate to the oil pan. The method also may include securing a reinforcing member to the oil pan. The reinforcing member, if installed prior to cutting the threads in the oil pan, would be taped along with the oil pan. The method further may include cutting a threaded bore into the oil pan for use as an oil drain.

In consideration of the above, an object of the invention is to provide an oil pan having a throughbore for access to engine components covered by the oil pan.

Another object of the invention is to provide an oil pan having an easily removable cover for accessing the contents of the oil pan.

A further object of the invention is to provide an oil drain for use with the present engine cover.

An additional object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWING

The FIGURE is a bottom side perspective view of the invention.

DETAILED DESCRIPTION OF THE PREFERRED EMBODIMENT

1. Engine Plate

Referring to the FIGURE, the invention shows a conventional internal combustion engine oil pan 10. The oil pan 10 has a throughbore 12 disposed in the lower, generally horizontal surface 14 of the oil pan 10. The oil pan 10 also has a plurality of threaded bores 16 peripherally disposed about the throughbore 12.

A reinforcing member 13 may be secured to the oil pan 10. The reinforcing member 13 is generally flat, and extends entirely around the throughbore 12, as shown in the FIG- URE. The preferred means for securing the reinforcing member 13 is welding. However, any equivalent means for demountably fixing the reinforcing member 13 to the oil pan 10 will suffice. The reinforcing member 13 should be mounted prior to cutting the threaded bores 16 in the oil pan 10. The reinforcing member 13 would then be assured of having threaded bores (not shown) in registration with the threaded bores 16 in the oil pan 10.

A gasket 18 sealingly mates with the peripheral edge 19 of the oil pan 10. The gasket 18 is generally planar, and extends entirely across the throughbore 12, as shown in the FIGURE. The gasket 18 be may be constructed from any conventional material commonly used in similar applications. The gasket 18 has a like number of throughbores 20 as threaded bores 16 in the oil pan 10. The throughbores 20 are in registration with the threaded bores 16. The throughbores 20 are substantially similar or larger than the threaded bores 16 in the oil pan 10.

A plate 22 sealingly mates with the gasket 18. The plate 22 is generally planar, and extends entirely across the throughbore 12, as shown in the FIGURE. The plate 22 may be constructed from any conventional material commonly used in similar applications. The plate 22 has a like number of throughbores 24 as threaded bores 16 in the oil pan 10. The throughbores 24 are in registration with the threaded bores 16. The throughbores 24 are substantially similar or larger than the threaded bores 16 in the oil pan 10.

Conventional bolts 26 are received in throughbores 20 and 24 and threadingly interengage the threaded bores 16 in the oil pan 10. Tightening the bolts 26 clampingly maintains the plate 22 and gasket 18 against the peripheral edge 19 of the throughbore 12 in the oil pan 10.

A user will be able to loosen the bolts 26 and remove the plate 22 and gasket 18 to access the contents of the oil pan 10. This accessibility will usefully permit the user to perform maintenance operations on the engine previously reserved to seasoned professionals having professional equipment.

2. Engine Plate Installation Method

Referring again to the FIGURE, the present method is for installing the removable engine plate. The method includes cutting a throughbore 12 in the oil pan 10. The throughbore 12 is shown having a square shape, however, any shape suited for the intended purposed of the invention will suffice.

The invention includes cutting threaded bores 16 about the peripheral edge 19 of the throughbore 12. The preferred embodiment includes twenty-two threaded bores 16. Twelve threaded bores 16 are shown for clarity only.

The invention provides for mating a gasket 18 to the oil pan 10. The gasket 18 may be constructed from any material suited to the purposes of the invention.

The invention also provides for mating a plate 22 to the gasket 18. Threaded fasteners 26 may provide the means for securing the plate 22 and gasket 18 to the oil pan 10, however any equivalent means will due.

The method may include securing a reinforcing member 13 to the oil pan 10. The reinforcing member 13 should be secured to the oil pan 10 prior to the step of cutting threaded bores 16 in the oil pan 10. The sequence is suggested to assure registration of the threaded bores (not shown) of the reinforcing member 13 with the threaded bores 16 of the oil pan 10.

The invention provides for securing the plate 22 and gasket 18 to the oil pan by inserting threaded fasteners 26 through the throughbores 24 and 20 of the plate 22 and gasket 18, respectively. The invention provides for interengaging the threaded fasteners 26 with the threaded bores 16 of the oil pan 10. Tightening the threaded fasteners 26 against the plate 22 clampingly secures the plate 22 and gasket 18 to the oil pan 10.

The invention also may include an additional step of cutting a threaded throughbore 28 into the oil pan 10. The throughbore 28 may be required to permit drainage of the oil from the oil pan 10.

The present invention is not intended to be limited to the sole embodiment described above, but to encompass any and all embodiments within the scope of the following claims.

I claim:

1. An engine plate for an internal combustion engine oil pan, the oil pan having a throughbore, the throughbore having a peripheral edge, the engine plate comprising:

a reinforcing member contacting the peripheral edge of the oil pan for structurally enhancing the oil pan, said reinforcing member being generally flat, and extending entirely around the throughbore;

a gasket dimensioned and configured to sealingly mate with the peripheral edge of the oil pan, said gasket being generally planar, and extending entirely across the throughbore;

a plate dimensioned and configured to mate with said gasket, said plate being generally planar, and extending entirely across the throughbore; and means for demountably fixing said gasket and said plate to the engine oil pan.

2. The engine plate as recited in claim 1, said means for demountably fixing said gasket and said plate to the engine oil pan comprising:

the oil pan having a plurality of threaded bores disposed about the peripheral edge of the oil pan;

said gasket having a like number of throughbores as threaded bores disposed in the oil pan, each said throughbore being in registration with said threaded bores in the oil pan, respectively;

said plate having a like number of throughbores as threaded bores disposed in the oil pan, each said throughbore being in registration with said threaded bores in the oil pan, respectively; and a like number of threaded fasteners as threaded bores disposed in the oil pan, said threaded fasteners being received in said throughbores in said plate and said gasket and threadingly interengaging said threaded bores in the oil pan.

3. A method for installing a removable plate in an oil pan comprising the steps of:

cutting a throughbore in the oil pan;

mounting a reinforcing member to the peripheral edge of the throughbore in the oil pan, said reinforcing member being generally flat, and extending entirely around the throughbore;

mating a gasket to the peripheral edge of the throughbore in the oil pan, said gasket being generally planar, and extending entirely across the throughbore;

mating a plate to the gasket, said plate being generally planar, and extending entirely across the throughbore;

maintaining the plate and gasket against the oil pan.

4. The method as recited in claim 3, said maintaining the plate and gasket against the oil pan step further including the steps of:

cutting tapped bores about the peripheral edge of the throughbore in the oil pan;

cutting throughbores in the plate and the gasket, the throughbores being in registration with the threaded bores in the oil pan;

inserting threaded fasteners through the through bores in the plate and the gasket;

interengaging the threaded fasteners with the threaded bores in the oil pan; and tightening threaded fasteners against the plate and gasket.

5. The method as recited in claim 3, further including the step of cutting a threaded bore in the oil pan for receiving a drain plug.

* * * * *